US009039815B2

(12) United States Patent
Dunn

(10) Patent No.: US 9,039,815 B2
(45) Date of Patent: May 26, 2015

(54) VANE ELECTROSTATIC PRECIPITATOR

(71) Applicant: John P. Dunn, Horseheads, NY (US)

(72) Inventor: John P. Dunn, Horseheads, NY (US)

( * ) Notice: Subject to any disclaimer, the term of this patent is extended or adjusted under 35 U.S.C. 154(b) by 292 days.

(21) Appl. No.: 13/792,408

(22) Filed: Mar. 11, 2013

(65) Prior Publication Data

US 2013/0186270 A1 Jul. 25, 2013

Related U.S. Application Data

(63) Continuation-in-part of application No. 13/724,286, filed on Dec. 21, 2012, which is a continuation-in-part of application No. 13/369,823, filed on Feb. 9, 2012, now Pat. No. 8,894,745.

(60) Provisional application No. 61/521,897, filed on Aug. 10, 2011.

(51) Int. Cl.

| | |
|---|---|
| ***B03C 3/47*** | (2006.01) |
| ***B03C 3/45*** | (2006.01) |
| ***B03C 3/41*** | (2006.01) |

(52) U.S. Cl.

CPC ... *B03C 3/47* (2013.01); *B03C 3/45* (2013.01); *B03C 3/41* (2013.01)

(58) Field of Classification Search

USPC ..... 95/57, 59, 58, 61, 62, 63, 69, 70, 78, 95/79–81; 96/15, 17, 54, 55–58, 74, 96/75–79, 95–97, 98–100, 70, 60, 65, 64, 96/66, 67, 68, 69

See application file for complete search history.

(56) References Cited

U.S. PATENT DOCUMENTS

| | | | |
|---|---|---|---|
| 1,956,591 | A | 5/1934 | Gies |
| 2,357,734 | A | 9/1944 | Haber |
| 2,700,429 | A | 1/1955 | Wintermute |
| 2,712,858 | A | 7/1955 | Wintermute |
| 2,969,127 | A | 1/1961 | Cook |
| 3,271,932 | A | 9/1966 | Newell |
| 3,338,035 | A | 8/1967 | Dinkelacker |
| 3,355,864 | A | 12/1967 | Sobeck |
| 3,478,494 | A | 11/1969 | Lustenader et al. |
| 3,678,653 | A | 7/1972 | Buschman |
| 3,693,328 | A | 9/1972 | Paucha |
| 3,733,785 | A | 5/1973 | Gallaer |
| 3,757,498 | A | 9/1973 | Hurlbut, Sr. et al. |

(Continued)

FOREIGN PATENT DOCUMENTS

| | | | |
|---|---|---|---|
| DE | 545606 | C | 3/1932 |
| EP | 0237512 | A1 | 9/1987 |
| EP | 1131162 | B1 | 2/2006 |

OTHER PUBLICATIONS

Turner et al., "Sizing and Costing of Electrostatic precipitators, Part 1", Journal of Waste Manage Association, vol. 38, pp. 458-471, 1988.

*Primary Examiner* — Duane Smith
*Assistant Examiner* — Sonji Turner
(74) *Attorney, Agent, or Firm* — Brown & Michaels, PC

(57) ABSTRACT

Vane electrostatic precipitators preferably have the leading edges of the vanes directly opposite the discharge electrodes, and/or the distance between the discharge electrode and the leading edge of the vane electrode is less than the distance between the discharge electrodes improves the collection process. These designs improve collection efficiency of the vane electrostatic precipitators.

10 Claims, 7 Drawing Sheets

(56) References Cited

U.S. PATENT DOCUMENTS

| | | | | | |
|---|---|---|---|---|---|
| 3,807,140 | A | | 4/1974 | Gurvits et al. | |
| 3,958,962 | A | * | 5/1976 | Hayashi | 96/97 |
| 4,007,023 | A | | 2/1977 | Batza | |
| 4,093,432 | A | | 6/1978 | Ahlrich | |
| 4,172,028 | A | | 10/1979 | Dunn | |
| 4,178,156 | A | | 12/1979 | Tashiro et al. | |
| 4,181,509 | A | | 1/1980 | Honacker et al. | |
| 4,231,766 | A | | 11/1980 | Spurgin | |
| 4,246,010 | A | | 1/1981 | Honacker | |
| 4,264,343 | A | | 4/1981 | Natarajan et al. | |
| 4,265,641 | A | | 5/1981 | Natarajan | |
| 4,412,850 | A | | 11/1983 | Kurata et al. | |
| 4,478,614 | A | | 10/1984 | Jonelis | |
| 4,481,017 | A | | 11/1984 | Furlong | |
| 4,666,475 | A | | 5/1987 | Gustavsson | |
| 4,713,092 | A | * | 12/1987 | Kikuchi et al. | 96/70 |
| 4,725,289 | A | | 2/1988 | Quintilian | |
| 4,832,710 | A | | 5/1989 | Jury | |
| 5,156,658 | A | | 10/1992 | Riehl | |
| 5,215,558 | A | | 6/1993 | Moon | |
| 5,466,279 | A | | 11/1995 | Hattori et al. | |
| 5,547,493 | A | | 8/1996 | Krigmont | |
| 5,601,791 | A | * | 2/1997 | Plaks et al. | 422/169 |
| 5,993,521 | A | | 11/1999 | Loreth et al. | |
| 6,004,376 | A | | 12/1999 | Frank | |
| 6,152,988 | A | * | 11/2000 | Plaks et al. | 95/58 |
| 6,482,253 | B1 | | 11/2002 | Dunn | |
| 6,524,369 | B1 | | 2/2003 | Krigmont | |
| 6,773,489 | B2 | | 8/2004 | Dunn | |
| 6,962,620 | B2 | | 11/2005 | Chang et al. | |
| 7,022,166 | B2 | | 4/2006 | Gittler | |
| 7,105,041 | B2 | | 9/2006 | Dunn | |
| 7,582,144 | B2 | | 9/2009 | Krigmont | |
| 7,582,145 | B2 | * | 9/2009 | Krigmont | 96/66 |
| 7,585,352 | B2 | | 9/2009 | Dunn | |
| 7,901,489 | B2 | | 3/2011 | Jin et al. | |
| 2001/0039877 | A1 | | 11/2001 | Hein | |
| 2009/0071328 | A1 | | 3/2009 | Dunn | |
| 2010/0037766 | A1 | | 2/2010 | Boyden et al. | |
| 2010/0037767 | A1 | | 2/2010 | Boyden et al. | |
| 2011/0139009 | A1 | * | 6/2011 | Nakahara et al. | 96/95 |

* cited by examiner

VANE ELECTROSTATIC PRECIPITATOR

REFERENCE TO RELATED APPLICATIONS

This is a continuation-in-part patent application of co-pending application Ser. No. 13/724,286, filed Dec. 21, 2012, entitled "VANE ELECTROSTATIC PRECIPITATOR", which is a continuation-in-part patent application of co-pending application Ser. No. 13/369,823, filed Feb. 9, 2012, entitled "VANE ELECTROSTATIC PRECIPITATOR", which claims one or more inventions which were disclosed in Provisional Application No. 61/521,897, filed Aug. 10, 2011, entitled "VANE ELECTROSTATIC PRECIPITATOR (VEP)". The benefit under 35 USC §119(e) of the United States provisional application is hereby claimed, and the aforementioned applications are hereby incorporated herein by reference.

BACKGROUND OF THE INVENTION

1. Field of the Invention

The invention pertains to the field of electrostatic precipitators. More particularly, the invention pertains to vane electrostatic precipitators.

2. Description of Related Art

U.S. Pat. No. 4,172,028 discloses an electrostatic sieve having parallel sieve electrodes that are either vertical or inclined. The particles are normally introduced into the electric sieve under the control of a feeder that is placed directly in front of the opposing screen electrode. The powder is attracted directly from the feeder tray to the opposing screen electrode by an induced electric field that exists between the tray and the screen electrode. This system is a static air system.

U.S. Pat. No. 4,725,289 uses flow dividers in an electrostatic precipitator to try to control flow. Discharge of collected dust particles is still taking place where the air flow is relatively high, making re-entrainment a strong possibility.

Prior art precipitators have difficulty collecting highly conductive and very poorly conductive particulates.

There is also a need to improve on present electrostatic precipitator technology used to continuously collect coarse and fine coal ash particles from coal fired boilers related to the fact that bag houses are now used in conjunction with electrostatic precipitators to better clean the air.

SUMMARY OF THE INVENTION

The embodiments described herein improve on the present electrostatic precipitator method of using parallel plates to collect particulates. Placing the leading edges of the vanes directly opposite the discharge electrodes, and/or the distance between the discharge electrode and the leading edge of the vane electrode being shorter than the distance between the discharge electrodes improves the collection process.

In one preferred embodiment, a method for removing particles from at least one main narrow air stream uses a vane electrostatic precipitator to collect the particulates using an electrical field established between a leading edge of a plurality of vane electrodes and a plurality of discharge electrodes. The discharge electrodes are located in proximity to the leading edge of the vane electrodes, and a distance between the leading edge of the vane electrodes and the discharge electrode is less than a distance between adjacent discharge electrodes. In preferred embodiments, a ratio between a number of vane electrodes and a number of discharge electrodes in a vane assembly is less than 2:1 and more preferably, approximately 1:1.

In another preferred embodiment, a vane electrostatic precipitator includes a plurality of vane electrodes each with a leading edge, and a plurality of discharge electrodes, where a distance between the leading edge of the vane electrodes and the discharge electrode is less than the distance between adjacent discharge electrodes. In preferred embodiments, a ratio between a number of vane electrodes and a number of discharge electrodes in a vane assembly is less than 2:1 and more preferably, approximately 1:1.

In a preferred embodiment, a method for removing particles from at least one main narrow air stream using a vane electrostatic precipitator includes the step of collecting the particulates using an electrical field established between a leading edge of a plurality of vane electrodes and a plurality of discharge electrodes. The vane electrostatic precipitator includes the plurality of vane electrodes and the plurality of discharge electrodes in proximity to the leading edge of the vane electrodes, and a ratio between a number of vane electrodes and a number of discharge electrodes in a vane assembly is less than 2:1. In a further preferred embodiment, the ratio between the number of vane electrodes and the number of discharge electrodes in a vane assembly is approximately 1:1.

In another preferred embodiment, a vane electrostatic precipitator includes a plurality of vane electrodes, each vane electrode comprising a leading edge, and a plurality of discharge electrodes, where a ratio between a number of vane electrodes and a number of discharge electrodes in a vane assembly is less than 2:1. In a further preferred embodiment, the ratio between the number of vane electrodes and the number of discharge electrodes is approximately 1:1.

DETAILED DESCRIPTION OF THE INVENTION

The terms "vane", "vane electrode", and "vane type collecting electrode" are used interchangeably herein.

Several new factors have been identified as having a major bearing on the collection efficiency of a vane electrostatic precipitator. These include the vane offset, the width of the orifices (with wider orifices, the air flow capacity increases and, in some applications, the length of the field is reduced), the vane assembly angle, the number of discharge electrodes in relation to the number of vane electrodes, and the position of discharge electrodes in relation to the leading edges of the vane electrodes.

In some embodiments, the methods and vane electrostatic precipitators described herein improve the collection of particulates by using a high concentration of discharge electrodes per vane assembly. In one preferred embodiment, the ratio of the number of vane electrodes to the number of discharge electrodes in at least one vane assembly is less than 2:1. In a further preferred embodiment, the ratio of the number of vane electrodes to the number of discharge electrodes in at least one vane assembly is approximately 1:1. The preferred 1:1 ratio is based on having the strongest electrical field possible and this occurs when the discharge and vane electrodes are directly opposite each other. This does not imply that there are an equal number of discharge and vane electrodes in the entire precipitator. For most applications, discharge electrodes are not used near the exit end of collection chamber but several rows of vanes are required for efficient collection after the discharge electrodes end.

A vane assembly, as described herein, is a group of vanes that are structurally assembled as one unit.

In one preferred embodiment, a vane electrostatic precipitator includes a plurality of vane electrodes and the plurality of discharge electrodes in proximity to the leading edge of the vane electrodes, where a distance between the leading edge of the vane electrodes and the discharge electrode is smaller than a distance between adjacent discharge electrodes.

In preferred embodiments, methods and precipitators reduce the amount of ozone generated compared to prior art electrostatic precipitators by operating just above the power required to produce a corona discharge.

In some preferred methods, the electrical power required to generate a corona that is used to charge particles is reduced compared to the electrical power required in prior art precipitators. This is based on a number of factors, including, but not limited to, electrically operating close to the corona onset voltage, having both the vane and discharge electrodes in close proximity, and having a high ratio of discharge and vane electrodes within a vane assembly.

Figure 1:
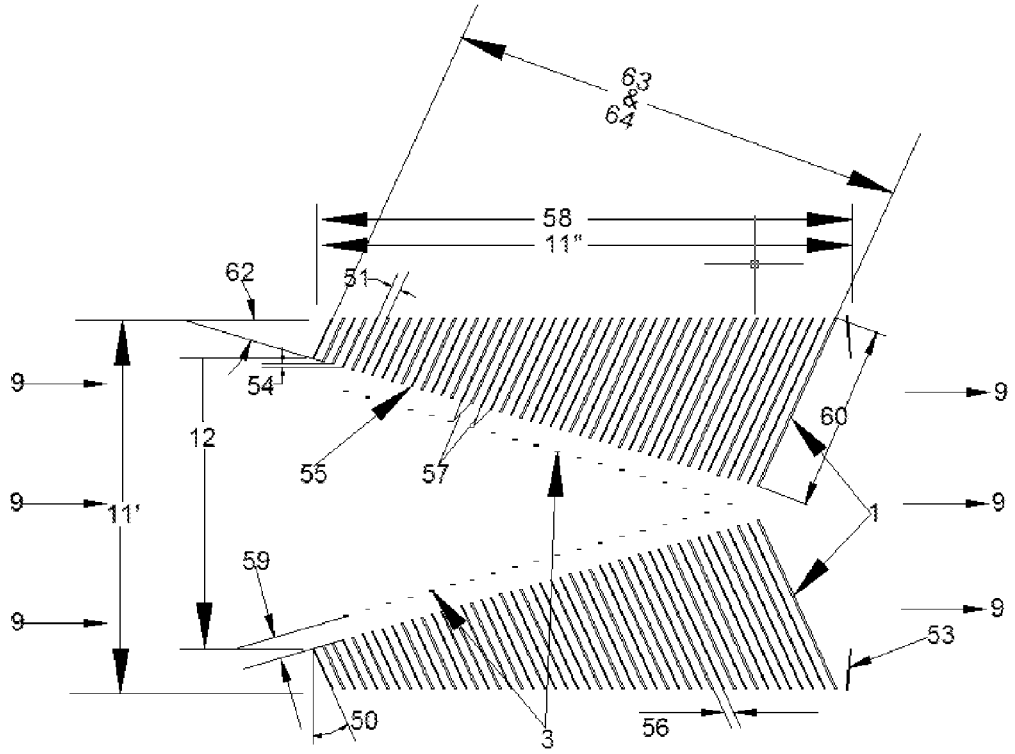
FIG. 1 shows a cross sectional view of one embodiment of a vane assembly found in a single chamber with various components that affect efficient collection.

FIG. 1 shows a vane electrostatic precipitator in an embodiment of the present invention. Air flow (9) enters through an input orifice (12). FIG. 1 shows some of the main factors that affect how the vane electrostatic precipitator functions. These include the vane operating angle (50), the distance (51) between vanes (1), the total vane surface area (53) (which includes the surface area on both sides of each vane) per collection chamber (11), the amount of offset (54) of the vanes (1), the vane width (60), the vane assembly angle (62), the number (57) of vanes (1) per collection chamber (11), and the number of vanes (1) per the number of discharge electrodes (3).

The number of vanes per field and the vane area per field are related to the selection of the type of vane (1) design and to the desired efficiency of a vane electrostatic precipitator.

Note that the collection chamber (11) includes the width (11'), length (11"), and height (not shown) dimensions. The vane width (60) in a vane group (63) (two or more vanes that are grouped together to operate with the same operating parameters) may be constant or may vary along the length of the field (58), as shown in FIG. 1.

In developing the vane electrostatic precipitator, several new factors were discovered that have a major bearing on the collection efficiency of the vane electrostatic precipitator. These include the vane offset (54), the distance (59) the discharge electrodes (3) are from the leading edge (55) of the vane electrodes (1) and the vane assembly angle (62).

The vane offset (54) refers to how much longer the next vane (1) is in relation to the preceding one. This offset (54), in combination with the distance (51) between a vane pair (two vanes) (56) determines the percent of the main air flow (9) that is expected to flow between each vane pair (56). The distance (51) between the vane pair (56) is preferably measured between the inside surface of each of the vanes (1) in the vane pair (56).

Figure 2:
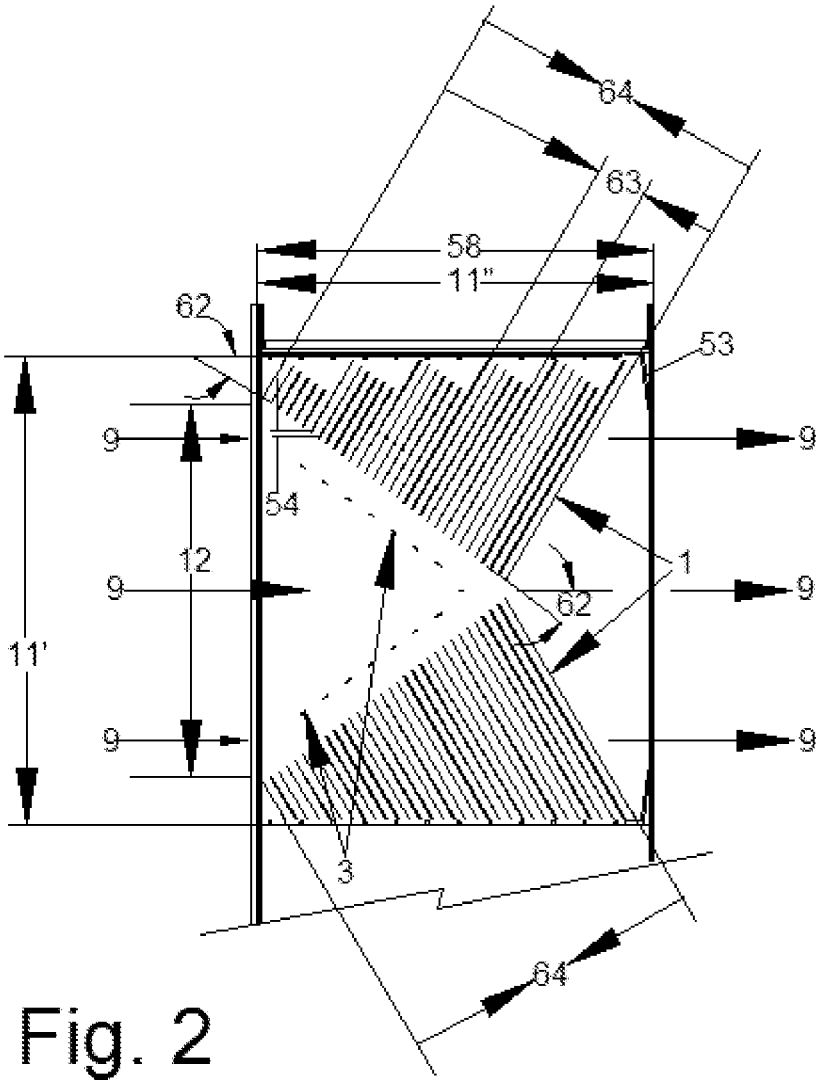
FIG. 2 shows a cross sectional view showing the saw tooth discharge electrodes aligned to be in the direction of the main air flow and to follow the leading angle of the vane electrodes.

The greater the offset (54), the larger the percentage of air diverted from the main air stream (9). This results in a number of other changes, including that the air flow rate increases with less flow interference, resulting in the possibility that vanes with a larger surface area are required but at the same time a lower number of vanes are used per chamber, as shown in FIG. 2. FIG. 2 has approximately 1½ times greater vane offset (54) than FIG. 1.

The type of discharge electrodes (3) (for example saw tooth discharge electrodes as shown in all four figures), the number of discharge electrodes (3), the position of the discharge electrodes (3), either parallel to the main air flow (9) or parallel to the vane operating angle (50), and the number of vanes (1) required per discharge electrode (3) are based on factors related to the type of material being processed and the power restrictions. In preferred embodiments, the discharge electrodes (3) are parallel to the main air flow (9) (as shown in FIG. 1). This reduces the power needs of the vane electrostatic precipitator, as well as making the charging process more efficient. In some embodiments, distances of approximately 1 to 2 inches between the leading edge (55) of the vane (1) and the discharge electrodes (3) are preferred.

If circular wire discharge electrodes (3) are used, the directional placement in relation to the vanes (1) is not an issue, just the location. For this particular application. the saw tooth discharge electrode (3) is the preferred choice because of its uniformity of discharge along its length and, depending on its size, can affect the air flow.

The selection of the vane operating angle (50) and the vane width (60) are dependent on a number of factors, but one of the major factors is related to the amount of drag or interference to the flow that is required to meet the desired collection vane exit flow rate of less than <1 ft/s. Sharper angles (50) and wider (60) vanes (1) increase the interference to flow.

The distance (51) between the vanes (1) can have two effects on the process. It can determine whether both sides of the vanes (1) collect particulates and the amount of turbulence or drag induced on the entrained air. Collecting on both sides of the vanes is a desirable feature because it also reduces the overall length of the vane electrostatic precipitator. For applications where the particle concentration per cubic centimeter is high, the distance (51) between the vanes may have to be increased.

The required vane surface area (53) per collection chamber (11) and the number of fields (58) are related to the actual cubic feet per minute (ACFM) of air flow and the desired efficiency of the vane electrostatic precipitator.

Figure 3:
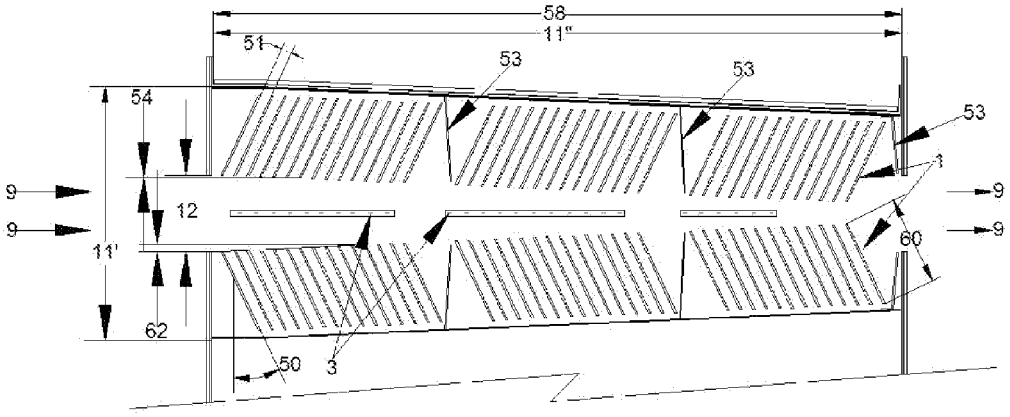
FIG. 3 is a cross sectional view of a vane electrostatic precipitator where the vane assembly angle is small in order to achieve high cubic flow per minute (CFM) using high air flow rates.

FIG. 3 is cross sectional view of a vane electrostatic precipitator where the air flow rates are very high (>20 ft/m) in order to achieve a high volume of air flow (CFM). FIG. 3 shows the vane assembly tapered from front to back and towards a center of the main air flow of the collection chamber, which improves control and efficiency of collection of the particles.

FIG. 3 shows a vane assembly angle (62) of approximately 1 to 3 degrees, while in FIGS. 1 and 2, the vane assembly angles (62) are preferably at 16 and 30 degrees, respectively. For efficient operation, the ratio of field length (58) to the aperture input orifice opening (12) is high and the vane offset (54) is very small because of the higher volume of air flow each vane is expected to handle. The discharge electrodes in FIG. 3 are centrally located and are assembled into groups that operate at different power levels.

FIG. 3 shows an example of an operating unit where the field length (58) is 40 inches, the input orifice (12) is 4.37 inches, and the vane offset is 0.025". The ratio of field length (58) to the aperture/input orifice opening (12) is approximately 9:1. The small vane offset and the high ratio of the field length (58) to the aperture/input orifice opening (12) has resulted in efficient collection of particles. These dimensions are examples only, and the preferred dimensions for each application will depend on process requirements.

Figure 4:
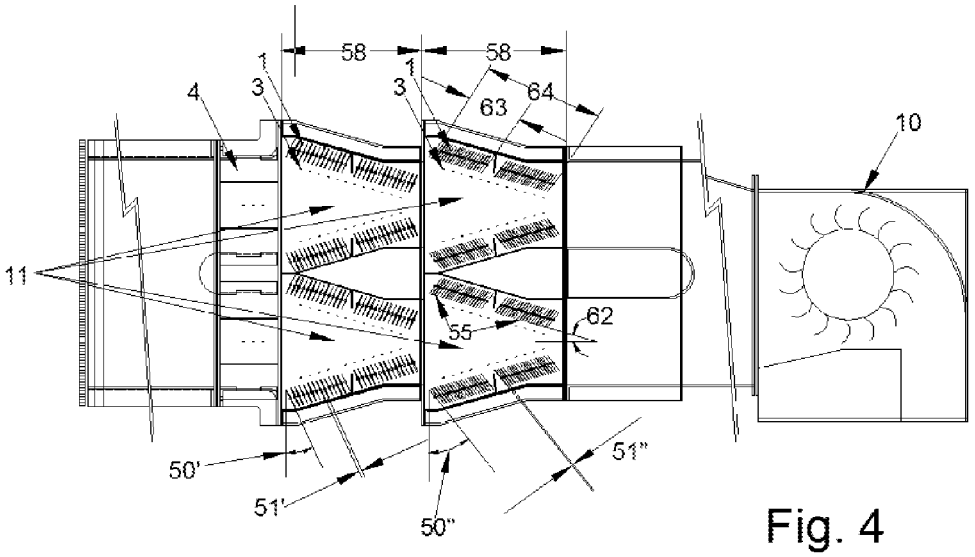
FIG. 4 shows a cross sectional view of a vane electrostatic precipitator that has two fields and four collection chambers.

FIG. 4 shows a cross sectional view of a vane electrostatic precipitator assembly that has a pre-charger (4), a two-field (58), four-chamber (11) vane electrostatic precipitator that has vanes (1) preferably set at 25 degree (50') and 42 degree (50") angles with two different spacing's (51') (51") between the vanes (1). A blower (10) is also shown. FIGS. 1, 2 and 4 also show the discharge electrodes (3) in a V-shape arrangement. This arrangement is more effective in charging the particulates when the vane assembly angle (62) becomes large, resulting in less power being required because of the closer proximity of the vanes (1) to the discharge electrodes (3).

FIG. 4 shows how the vane assembly angle (62) is equal to the angle the leading edge (55) of the vanes (1) makes with the center line of the main air flow (9). The selection of the vane assembly angle (62) is based on the foot print restrictions, air flow rates and capacity requirements. FIG. 4 also shows how the vane assembly (64) can be divided into groups (63) for making the collection process and the fabrication both more efficient.

Figure 5:
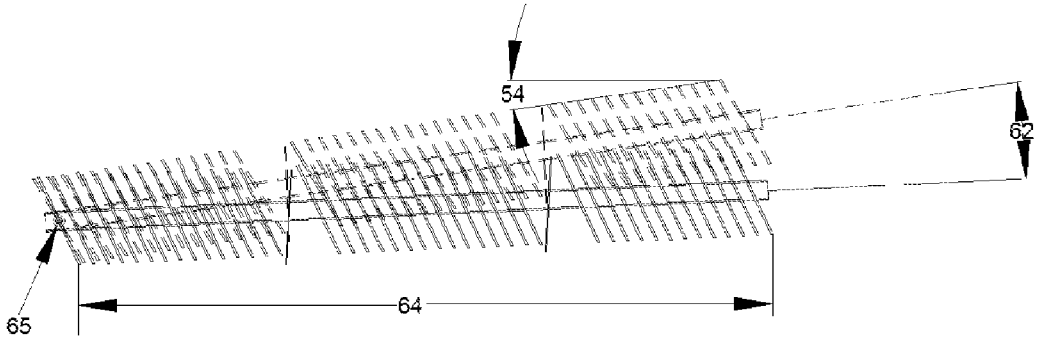
FIG. 5 shows a cross sectional view of a vane electrostatic precipitator where the vane assembly angle is changeable during operation.
Figure 6:
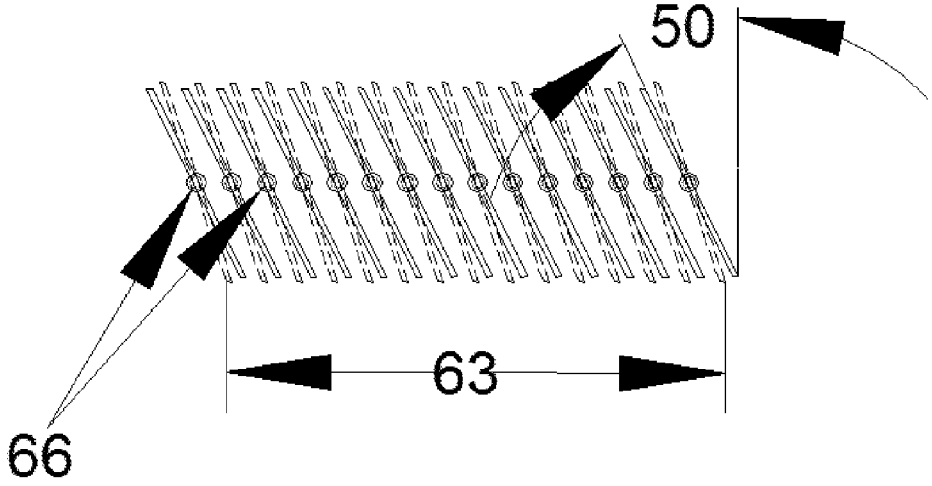
FIG. 6 shows a cross sectional view of a vane electrostatic precipitator where the vane operating angle is changeable during operation.

Other desirable operating features that will in some cases improve on the collection of particulates are the ability to change the vane assembly angle (62) and/or the vane operating angle (50) during operation. FIG. 5 shows the vane assembly (64) rotated at the pivot point (65) to a desired position. FIG. 6 shows a vane group (63) and the pivot points (66) for adjusting the vane operating angle (50). An advantage of these capabilities is related to the ability to adjust for major changes in operating temperature or mass flow (particle concentration), especially during the start up of the process.

Figure 7:
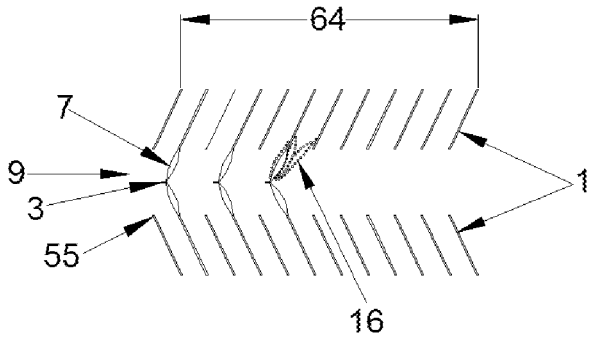
FIG. 7 shows a horizontal cross sectional view of a vane and discharge electrode arrangement.

FIG. 7 shows a vane and discharge electrode arrangement, where the entrained air (9) is passed over three discharge electrodes (3) that are centered between opposing vane assemblies (64), each including twelve vane electrodes (1). Collection of fine particles (16) occurred mainly on the vane electrodes (1) that were directly opposite the discharge electrodes (3), while collection of the coarse material occurred on all of the vane electrodes (1). A strong electrical field (7) was maintained between the leading edge (55) of the vane electrodes (1) and the discharge electrodes (3).

These results indicate that two processes are occurring during the collection phase. The collection of the coarse particles is vane angle-responsive and position-responsive and the collection process for fine particles is related to the number of discharge electrodes per number of vane electrodes.

Studies have shown that with a larger number of discharge electrodes per vane assembly, the collection process is more efficient for both coarse particles and fine particulates. An electrode arrangement where the leading edge of the vanes are opposite the discharge electrodes results in a strong concentrated electrical field for the charged particles to follow and induces a high voltage pulse effect on the charged particles as they pass by successive combinations of vane and discharge electrodes, causing the particles to more efficiently follow the concentrated electrical field flux lines to the vane.

In one of the experiments performed with the configuration of FIG. 7, there was a one inch distance between discharge electrodes (3) and a ⅝ of an inch distance from the leading edge (55) of the vane electrode (1) to the discharge electrodes (3). During another experiment, the distance between the discharge electrodes (3) and the leading edge (55) of the vane electrodes (1) was ¾ of an inch and the distance between the discharge electrodes was one inch. Both electrode arrangements produced excellent (>99%) collection.

Figure 8:
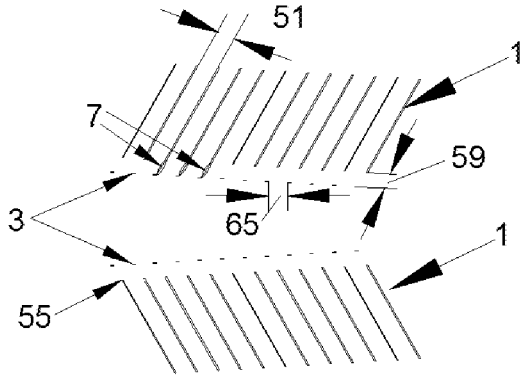
FIG. 8 shows a horizontal cross sectional view of a vane electrostatic precipitator tapered vane assembly electrode arrangement used to achieve a high CFM, where a 1:1 ratio is used for the number of vanes and discharge electrodes.

The use of a large number of discharge electrodes is illustrated in FIG. 8. In a preferred embodiment, there is a 1:1 correspondence between the number of vane electrodes (1) and the number of discharge electrodes (3) in at least one vane assembly. Since this is a tapered arrangement of the vane electrodes (1), each individual vane (1) has a corresponding discharge electrode (3). This electrode arrangement is possible if the distance (59) between the leading edge (55) of the vane electrode (1) and the discharge electrode (3) is shorter than the distance (65) between the discharge electrodes (3). If the distance (59) is not smaller than the distance (65), electrical interference occurs and reduces the amount of corona. This electrode arrangement assures that a strong electrical field (7) is maintained between the leading edge (55) of the vane (1) and the discharge electrode (3).

Using the electrode arrangements described, the vane electrostatic precipitator operates with a lower amount of electrical energy, but still has excellent collection and generates less ozone. This is accomplished by operating the vane electrostatic precipitator voltage and current just above the onset of a corona discharge. In contrast, the standard electrostatic precipitator practice is to operate with as high voltage and current as possible between the discharge and plate electrodes in order to achieve efficient collection.

Figure 9:
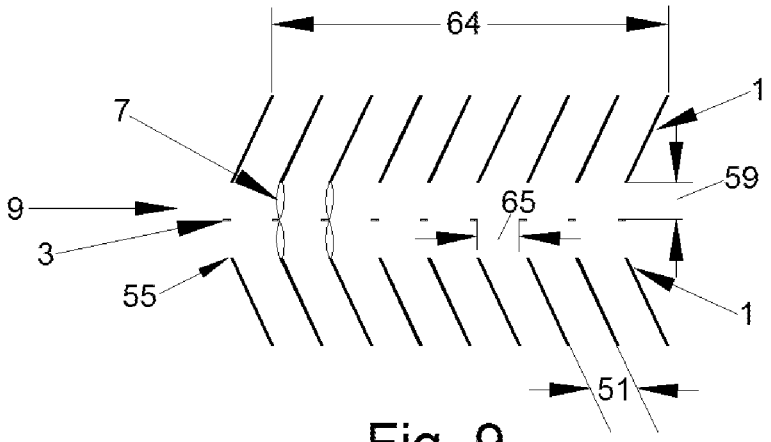
FIG. 9 shows a horizontal cross sectional view of a vane electrostatic precipitator parallel vane electrode arrangement where there is a 1:1 ratio between the number of vane electrode pairs and the discharge electrodes in a vane assembly.

FIG. 9 shows a vane electrostatic precipitator electrode arrangement having both a large number of opposing vane electrodes (1) (in a vane assembly (64)) on each side of the precipitator with a matching number of discharge electrodes (3), as well as having the discharge electrodes (3) located directly in line with the leading edge (55) of the vane electrodes (1). As in FIG. 8, the distance (59) between the leading edge (55) of the vane electrode (1) and the discharge electrode (3) is preferably shorter than the distance (65) between the discharge electrodes (3). If the distance (59) is not smaller than the distance (65), electrical interference occurs and reduces the amount of corona. This electrode arrangement assures that a strong electrical field (7) is maintained between the leading edge (55) of the vane (1) and the discharge electrode (3).

FIGS. 8 and 9 both show spacing between the discharge electrodes (65) that closely matches the spacing (51) between the vanes (1). This spacing is somewhat dependent on the type of discharge electrodes used, for example, circular wire electrodes, saw tooth electrodes (shown in the figures), or other types of discharge electrodes.

Figure 10:
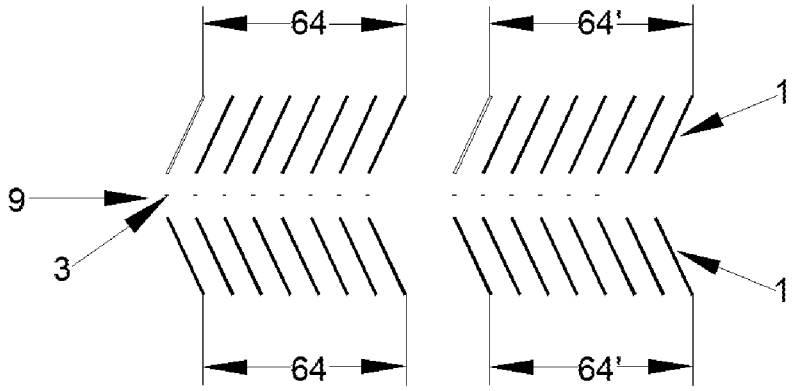
FIG. 10 shows a cross sectional view of a vane electrostatic precipitator.

As discussed above, the preferred 1:1 ratio between the vane electrodes (1) and the discharge electrodes (3) in at least one vane assembly (64) is based on having the strongest electrical field as possible, and this occurs when the discharge (3) and vane (1) electrodes are directly opposite each other. As shown in FIG. 10, this does not imply that you have an equal number of discharge (3) and vane electrodes (1) in the entire precipitator. FIG. 10 shows an application where the discharge electrodes (3) are not used near the exit end of the collection chamber, but additional vanes (1) are used after the discharge electrodes (3) end. The vane assemblies (64) have a 1:1 ratio between the discharge electrodes (3) and the vane electrodes (1) in each vane assembly (64). However, the vane assemblies (64') do not have discharge electrodes (3) at the exit end of the collection chamber.

Vane assemblies (64) and (64') are groups of vanes that are structurally assembled as one unit. The number of vanes assemblies (64), (64') used in a precipitator for a particular application depends on a number of factors. The primary factor is the air velocity. With higher air velocity, the vanes are preferably wider and more vane assemblies may be required.

Similar to FIGS. 8 and 9, in the configuration of FIG. 10, the distance (59) between the leading edge (55) of the vane electrode (1) and the discharge electrode (3) is preferably shorter than the distance (65) between the discharge electrodes (3). If the distance (59) is not smaller than the distance (65), electrical interference occurs and reduces the amount of corona. This electrode arrangement assures that a strong electrical field (7) is maintained between the leading edge (55) of the vane (1) and the discharge electrode (3).

FIGS. 8 through 10 show that the spacing (65) between the discharge electrodes (3) preferably closely matches the spacing between the vanes (51) in a vane assembly and is somewhat dependent on the type of discharge electrodes (3) used. Some examples of discharge electrodes (3) that could be used include, but are not limited to, circular, wire, saw tooth (shown in the figures), or other discharge electrodes (3) known in the art.

A mathematical formula given below shows the significance and sensitivity of the current density to the distance (59) (L) between the leading edge of the vane electrodes and the discharge electrodes:

$$j=\mu PV^2/L^3$$

where j=maximum current density ($A/m^2$)

μ=ion mobility ($m^2/V_s$)

P=free space permittivity ($8.845\times10^{-12}$F/M)

V=applied voltage (V)

L=shortest distance from discharge electrode to collecting surface (vane) (m).

("Sizing and Costing of Electrostatic precipitators, Part 1", James H. Turner, Phil A. Lawless, Toshiaki Yamamoto and David W. Coy, Research Triangle Institute, 1988, published in the *Journal of Waste Manage Association*, Vol 38, No 4, Pg. 462, herein incorporated by reference).

Listed below are a number of design parameters and operating variables that need to be considered and can be addressed by using computer modeling or by pilot model operating data, where some of the variables could be adjusted during the process to obtain the most efficient collection. Parameters a) through o) are specific parameters that are varied in embodiments discussed herein to improve collection and efficiency of the vane electrostatic precipitator.

Design Parameters and Operating Variables to Consider For the Vane Electrostatic Precipitator a) Operating angle of discharge electrode versus vane assembly angle
b) Vane operating angle
c) Distance between vanes
d) Spacing between discharge electrodes
e) Distance between leading edge of vane and discharge electrodes
Offset distance between vanes
g) Vane assembly operating angle (taper)
h) Vane assembly operating angle versus aperture dimension
i) Number of vane groups in a vane assembly
j) Type of dust to be collected
k) Dust concentration
l) Operating temperature (° C.)
m) ACFM required
n) Input air flow rate: (ACFS) versus width of vanes
o) Input air flow rate: (ACFS) versus number of fields
p) Plate collection area per ACFS
q) Vane collecting area per ACFS
r) Operating pressure (in w)
s) Migration velocity of particle to plate
t) Migration velocity of particle to vane
u) Aperture dimensions
v) Field, number and dimensions
w) Number of collecting chambers
x) Collection chamber dimensions
y) Angle and number of discharge electrodes per vane
z) Type and size of discharge electrode
aa) Power: (KW/ACFM) per collecting chamber
bb) Operating voltage (DC) per discharge bus bar
cc) Number of discharge electrodes per collection chambers
dd) Operating current per discharge bus par
ee) Power per discharger bus bar
ff) Type of vane, straight or contour and material
gg) Dimensions of vane (thickness, width, height, arc) (note: each vane may have a different width)
hh) Number of vanes per collection chamber
ii) Surface area per vane
jj) Number of vanes in a vane group
kk) Baffles, type, porous or solid Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for removing particles from at least one main narrow air stream using a vane electrostatic precipitator, comprising the step of:

collecting the particulates using an electrical field established between a leading edge of a plurality of vane electrodes and a plurality of discharge electrodes of the vane electrostatic precipitator, wherein the vane electrostatic precipitator comprises the plurality of vane electrodes and the plurality of discharge electrodes in proximity to the leading edge of the vane electrodes, wherein a distance between the leading edge of the vane electrodes and the discharge electrode is less than a distance between adjacent discharge electrodes.

2. The method of claim 1, wherein the vane electrostatic precipitator comprises the plurality of vane electrodes and the plurality of discharge electrodes in proximity to the leading edge of the vane electrodes, wherein a ratio between a number of vane electrodes and a number of discharge electrodes in at least one vane assembly is less than 2:1.

3. The method of claim 1, wherein the ratio between the number of vane electrodes and the number of discharge electrodes in at least one vane assembly is approximately 1:1.

4. A vane electrostatic precipitator comprising a plurality of vane electrodes, each vane electrode comprising a leading edge, and a plurality of discharge electrodes, wherein a distance between the leading edge of the vane electrodes and the discharge electrode is less than the distance between adjacent discharge electrodes.

5. The electrostatic precipitator of claim 4, wherein a ratio between a number of vane electrodes and a number of discharge electrodes in at least one vane assembly is less than 2:1.

6. The electrostatic precipitator of claim 4, wherein the ratio between the number of vane electrodes and the number of discharge electrodes in at least one vane assembly is approximately 1:1.

7. A method for removing particles from at least one main narrow air stream, using a vane electrostatic precipitator, comprising the step of:

collecting the particulates using an electrical field established between a leading edge of a plurality of vane electrodes and a plurality of discharge electrodes of the vane electrostatic precipitator, wherein the vane electrostatic precipitator comprises the plurality of vane electrodes and the plurality of discharge electrodes in proximity to the leading edge of the vane electrodes, wherein a ratio between a number of vane electrodes and a number of discharge electrodes in at least one vane assembly is less than 2:1.

8. The method of claim 7, wherein the ratio between the number of vane electrodes and the number of discharge electrodes in the at least one vane assembly is approximately 1:1.

9. A vane electrostatic precipitator comprising a plurality of vane electrodes, each vane electrode comprising a leading edge, and a plurality of discharge electrodes, wherein a ratio between a number of vane electrodes and a number of discharge electrodes in at least one vane assembly is less than 2:1.

10. The electrostatic precipitator of claim 9, wherein the ratio between the number of vane electrodes and the number of discharge electrodes in the at least one vane assembly is approximately 1:1.

* * * * *